US007306015B2

(12) United States Patent
Ter-Avetisyan et al.

(10) Patent No.: US 7,306,015 B2
(45) Date of Patent: Dec. 11, 2007

(54) DEVICE AND METHOD FOR THE CREATION OF DROPLET TARGETS

(75) Inventors: Sargis Ter-Avetisyan, Berlin (DE); Matthias Schnuerer, Berlin (DE); Peter-Viktor Nickles, Gross-Glienicke (DE)

(73) Assignee: Forschungsverbund Berlin e.V., Berlin (DE)

( * ) Notice: Subject to any disclaimer, the term of this patent is extended or adjusted under 35 U.S.C. 154(b) by 100 days.

(21) Appl. No.: 10/538,802

(22) PCT Filed: Dec. 11, 2003

(86) PCT No.: PCT/DE03/04129

§ 371 (c)(1),
(2), (4) Date: Jun. 13, 2005

(87) PCT Pub. No.: WO2004/056158

PCT Pub. Date: Jul. 1, 2004

(65) Prior Publication Data

US 2006/0054238 A1 Mar. 16, 2006

(30) Foreign Application Priority Data

Dec. 13, 2002 (DE) ..... 102 60 376

(51) Int. Cl.
*B65B 1/04* (2006.01)

(52) U.S. Cl. ..... 141/82

(58) Field of Classification Search ..... 141/2, 141/18, 67, 82; 378/119, 120, 143; 239/13, 239/101, 128, 132, 136
See application file for complete search history.

(56) References Cited

U.S. PATENT DOCUMENTS

| | | | | |
|---|---|---|---|---|
| 4,962,886 | A * | 10/1990 | Stockel | 239/11 |
| 6,324,256 | B1 | 11/2001 | McGregor et al. | 378/119 |
| 6,711,233 | B2 * | 3/2004 | Hertz et al. | 378/143 |
| 6,738,452 | B2 * | 5/2004 | McGregor et al. | 378/119 |
| 6,792,076 | B2 * | 9/2004 | Petach et al. | 378/119 |

FOREIGN PATENT DOCUMENTS

GB 347146 10/1929

OTHER PUBLICATIONS

David W. Minsek et al.: Photoelectrons Spectrum of Propargyl Radical in a Supersonic Beam; J.Phys.Chem. 1990, 94, 8399-8401.
L.C.Mountford et al.: Characterization of a sub-micron liquid spray for laser-plasma x-ray generation; Rev. Sci. Inst. vol. 69, No. 11, Nov. 1998, pp. 3780-3788.
M. Fink et al.: A high-temperature pulsed supersonic nozzle; Rev. Sci. Inst. vol. 64, No. 10, Oct. 1993, pp. 3020-3021.

(Continued)

*Primary Examiner*—Steven O. Douglas
(74) *Attorney, Agent, or Firm*—Karl Hormann, Esq.

(57) ABSTRACT

An apparatus for making a droplet target provided with a chamber for receiving a target liquid and maintained under pressure, an electromagnetic valve switched at a ms rate for feeding target liquid from the receptacle to a heated expansion channel for converting the target liquid to supersaturated vapor and connected to a supersonic nozzle wherein the supersaturated vapor is cooled and condensed to droplets before they are discharged.

13 Claims, 3 Drawing Sheets

OTHER PUBLICATIONS

S. Ter-Avetsisyan et al.: A high-density sub-micron liquid spray for laser driven radiation sources; J. Phys. D: Appl. Phys. 36 (2003), pp. 2421-2426.

Donnelly et al.: Hard X-ray and hot electron production from intense laser irradiation of wavelength-scale particles; J. Phys. B: At. Mol. Opt. Phys. 34 (2001) L313-L320.

Smith et al.: Characterization of a cryogenically cooled high-pressure gas jet for laser/cluster interaction experiments; Rev. Scient. Inst., vol. 69, No. 11, (1998), pp. 3798-3804.

L. Rymell et al.: Droplet target for low-debris laser-plasma soft X-ray generation; Optics Communications, vol. 103, No. 1.2 (1992); pp. 105-110.

O. Hemberg et al.: Stability of droplet-target laser-plasma soft X-ray sources; Journal of Applied Physics, vol. 88, No. 9, (2000); pp. 5421-5425.

* cited by examiner

DEVICE AND METHOD FOR THE CREATION OF DROPLET TARGETS

BACKGROUND OF THE INVENTION

1. Field of the Invention

The invention relates to an apparatus for making a droplet target provided with at least one receptacle for receiving a target liquid and in which high pressure is generated by means of gaseous nitrogen, a magnetic valve connected to the receptacle and switchable in the ms range, and a nozzle, as well as to a method of forming a droplet target.

2. The Prior Art

Hereafter, devices known in the prior art will be described by which liquid droplets are being generated wherein the interaction of laser beams aimed at these droplets generates X-rays or extreme ultra-violet light. Such rays are used, for instance, in microscopy and lithography.

U.S. Pat. No. 6,324,256 describing an arrangement of a laser plasma source for generating EUV light, also refers to a device for making droplet targets. The droplets made are of a diameter larger than the diameter of droplets generated by a gas fed through a nozzle where it condenses to form a cloud of clusters of extremely small particles. As described, a liquid is formed from the gas by means of a heat exchanger which reduces the temperature of the gas. The liquid is fed to a nozzle the opening of which increases in the direction of the exit opening. The droplets are formed in this section and then exit from the exit opening of the nozzle to interact with a laser beam for generating EUV light. However, it is not possible in this arrangement in a defined manner to set the size of the droplets. In this arrangement the gaseous initial material is converted to a liquid one. Moreover, the droplets interact with the laser very close to the nozzle which in consequence of the heat and erosion is destroyed.

In Opt. Common. 103, 105 (1993), L. Ramble and H. M. Hertz report on an X-ray source in which droplets of ethanol are used as the target. To generate these droplets, ethanol was pressed at 30 to 50 at into a vacuum chamber through a capillary of about 10 μm diameter tapering in the direction of the nozzle. In order to generate a liquid volume—in this case of a diameter of 15 μm—pressure surges were piezoelectrically produced at a frequency of about 1 MHz. The relatively large droplets were used for examining the interaction with laser radiation in an intensity range of $10^{12}$ to $10^{14}$ W/cm$^2$ as described by O. Hemberg, B. A. M. Henson, M. Berlund and H. M. Hertz in J. Appl. Phys. 88, 5421 (2000). Since in this case each individual droplet is interacting and the laser focus is but slightly larger than the diameter of the droplets of ethanol, the drift problem of the droplet source is of major importance, the project is especially directed to solving an exact droplet-laser synchronization.

Super dense droplet spray of a density of up to $10^{19}$ atoms/cm$^3$ and a droplet diameter of about 1 μm was produced by a droplet source described by L. C. Mountford, R. A. Smith and M. R. H. R. Hutchinson in Rev. Sci. Instrum. 69, 3780 (1998) and is the basis of the instant invention. The basis of this droplet source is a magnetic valve which forms the pulse of liquid and, therefore, the volume of the liquid. A receptacle was filled with a liquid and kept under high pressure by means of methanol. The valve is opened in synchronism with the laser pulse and for 2,500 μs to allow droplets to emerge from the nozzle. It was possible to produce droplets of lesser diameter of about 0.6 μm by subsequent electrostatic cleaving of the droplets. This, however, requires a technically complex arrangement.

However, the jog consisting of such droplets is of lower density, viz. about $10^{16}$ atoms/cm$^3$.

For effectively generating X-rays or EUV light it is necessary, however, to make available droplet targets of dimensions of the size of possible laser wavelengths (T. D. Donelly, M. Rust, I. Weiner, M. Allen, R. A. Smith, C. A. Steinke, S. Wilks, J. Zweiback, T. E. Cowan, and T. Ditmire, J. Phys. B: At. Mol. Opt. Phys. 34, L313 (2001)) and, therefore, of a smaller diameter compared to the prior art, and which form a spray of an atomic density of $>10^{18}$ atoms/cm$^3$.

OBJECT OF THE INVENTION

It is thus an object of the invention to provide a way by which such droplet targets can be produced. The high density is also to be realized at a greater distance from the nozzle, i.e., the droplet target, compared to the prior art, is of a superior collimation in order to extend the useful life of the nozzle.

SUMMARY OF THE INVENTION

The object is accomplished with an apparatus of the type referred to supra in which the nozzle, in accordance with the invention, is constituted by an supersonic nozzle, the vale is connected to the supersonic nozzle by an expansion channel, heating means are formed around the expansion channel such that the temperature may be set at a level at which a super saturated vapor is generated in the expansion channel, and an insulation is provided between the electromagnetic valve and the heating means.

The apparatus in accordance with the invention makes possible the generation of super dense sub-μ liquid targets required for examining the interaction between laser radiation and plasmas. In contrast to the mentioned prior art generating droplets in the saturated gas phase, the droplets in accordance with the invention are generated from super saturated vapor which condenses into a cloud of spray. The target generated by the apparatus of the invention consists of droplets of a mean diameter of about 150 nm and is of a mean atomic density of $>10^{18}$ atoms/cm$^3$. Such a target makes possible the examination of conditions, not hitherto researched, which exist between clusters (from several atoms to $10^{16}$ atoms/cluster to a local density approximating that of a solid) and solids. Moreover, relative to the advantages of a cluster target, the spatial extent of the droplets influences an increased volume charge limitation of hot electrons which, in turn, results in an improved coupling of the laser energy with the ions of the droplets. Thus, a much hotter plasma can be generated and the effect in the X-ray conversion can be improved. The droplet target produced with the device of the invention can be generated continuously and, in terms of time, is of unlimited operation.

Embodiments of the apparatus in accordance with the invention relate to the structure of their individual components. The pulsed electromagnetic valve operates at a pulse length of 2 ms; the length of the expansion channel is from two mm to two cm and its diameter is from at least 100 μm to at least one mm; the supersonic nozzle has a conical opening angle 2θ between 2° and 20°, an input opening diameter larger than 100 nm and a conical section of a length from 2 to 10 mm. After pressing the target liquid upon opening of the valve into the expansion channel where as a result of its being heated a supersaturated water vapor is present, it will expand during passage through the ultrasonic nozzle, cool, and form liquid droplets of the desired size and density, the parameters being determined by the dimensions of the expansion channel, its temperature and the prevailing pressure in it.

The method in accordance with the invention includes the following method steps: Filling of a target liquid into a container, in which a high pressure is generated by means of a non-reactive gas, brief opening of the receptacle by a pulsed electromagnetic valve, pulsed introduction of the target liquid into an expansion channel, heating of the expansion channel such that a supersaturated liquid vapor is generated, cooling of the vapor during passage to a supersonic valve connected to the expansion channel, discharge of the droplets from the output opening of the nozzle into a vacuum.

In some embodiments of the inventive method a pulsed electromagnet valve is used operating in the ms range and, more particularly, at a pulse duration of 2 ms. At each switching of the valve the target liquid is pressed into the expansion channel and the corresponding vapor is pressed into the supersonic nozzle. An expansion channel of from 2 mm to 2 cm in length and a diameter of at least 100 μm to at least one mm and a supersonic nozzle with a conical opening angle 2θ between 2° and 20°, an input opening diameter larger than 100 μm and a conically shaped section between two and ten mm in length are used. During its passage to the discharge opening of the nozzle the supersaturated gas is cooled in the nozzle. This leads to the formation of liquid droplets. It is further to be mentioned that in addition to the mentioned parameters of the expansion channel the diameter of the nozzle also determines the diameter of the liquid droplets emerging from the nozzle opening into a vacuum.

Compared to the prior art which constitutes the basis of the invention, the valve in accordance with the invention regulates the direct feeding into an additionally provided expansion channel in which the target liquid is heated. The thus present supersaturated gas is fed to the discharge opening of the nozzle and cooled causing droplets to be formed in the nozzle. By contrast, in the prior art arrangement, the valve switches the nozzle directly into its closed and open states which substantially lessens the effect on the formation and extent of the droplets and their collimation.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

FIG. 1 schematically depict the structure of an apparatus in accordance with the invention;

DESCRIPTION OF THE PREFERRED EMBODIMENT

Figure 1:
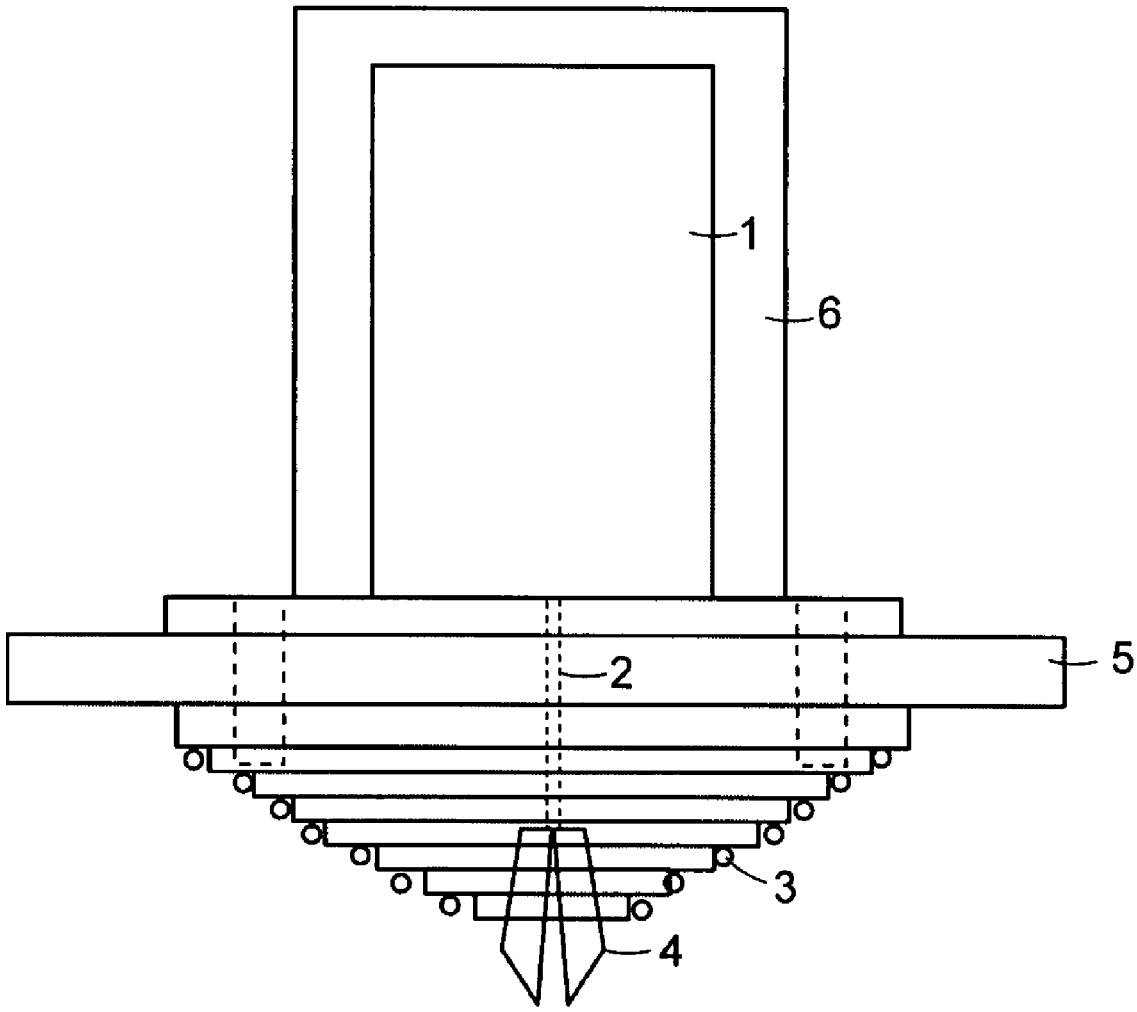

The apparatus in accordance with the invention for generating a droplet target is provided with a pulsed electromagnetic valve 1. The valve closes a receptacle 6, in which target liquid is maintained at a pressure of 35 bar by gaseous nitrogen. The target liquid may be water, but in principle it may be any other liquid as well. The valve 1 opens and closes at a pulse duration of 2 ms and, in its open phase, discharges water droplets into an expansion channel 2 of 1 mm diameter and 15 mm length. By means of a heater 3 a temperature of 150° C. is generated in the expansion channel 2. The expansion channel 2 is separated from the valve 1 by an insulator 5. The supersaturated water vapor present at the end of the expansion channel 2 is then fed through a supersonic nozzle 4. The nozzle 4 has an opening angle of 2θ=7°, an input opening of 500 μm in diameter and a conical section of 8 mm length and generates sub-μ liquid droplets into the vacuum. At the discharge opening of the supersonic nozzle 4, there is formed a droplet target which can be generated continuously and which makes possible an operation of unlimited duration.

Figure 2:
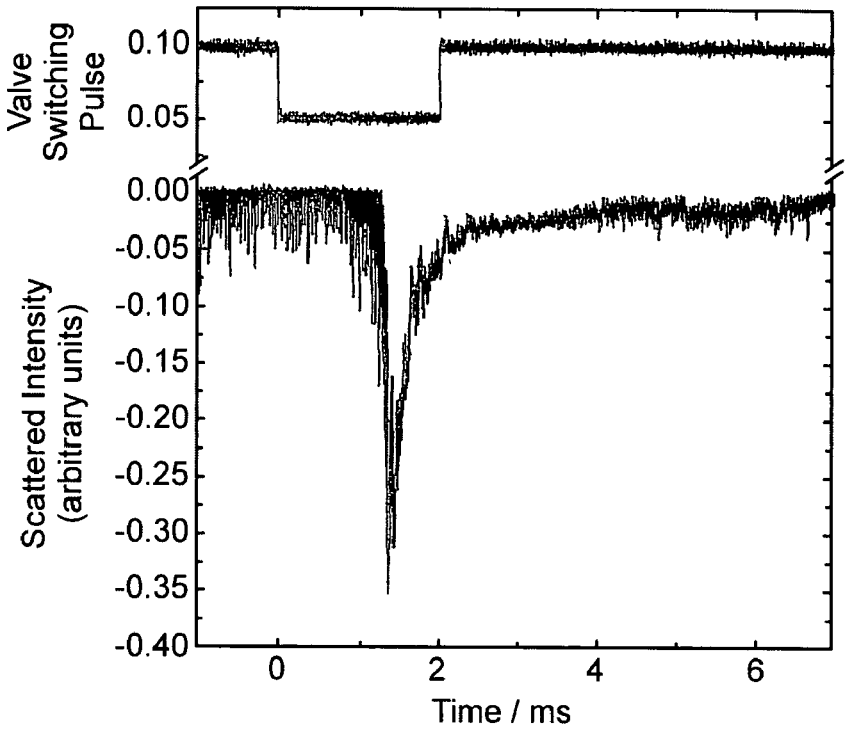
FIG. 2 is a curve of the switching pulse of the valve and the associated intensity of the liquid spray generated as a function of time.

FIG. 2 displays a curve of the switching pulse of the valve and the associated intensity of the generated liquid spray as a function of time at a distance of 1 mm from the discharge opening of the nozzle. In this measurement during which the radiation generated by a cw He—Ne-laser was directed to and scattered by the droplet target, and the intensity of the scattered radiation at a spacing of 1 mm from the nozzle opening was determined, the pulse duration of the valve was 2 ms. It can be seen that the major portion of the spray pulse occurs about 1 ms after opening of the valve.

Figure 3:
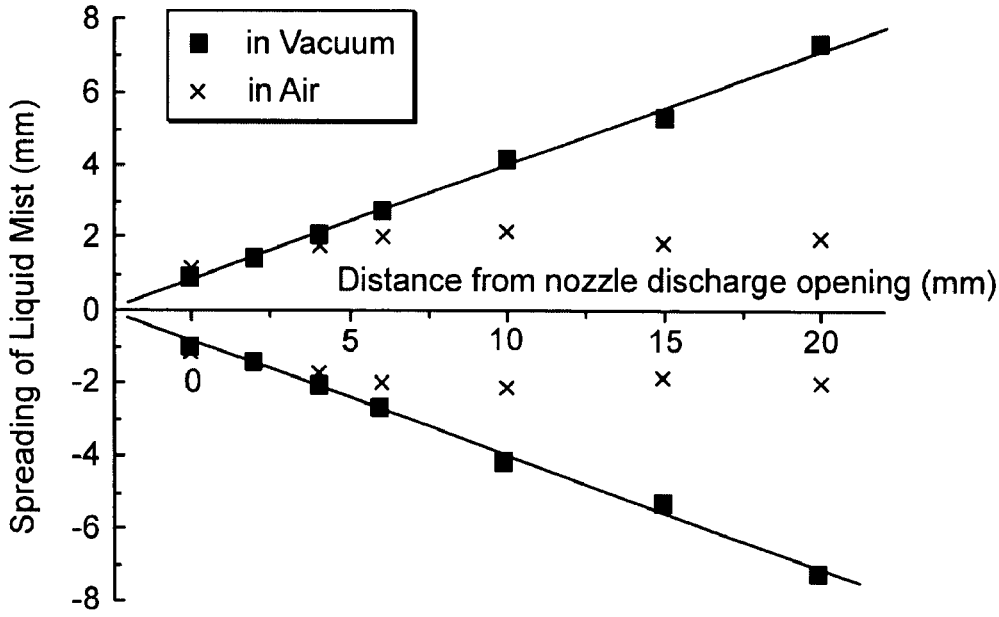
FIG. 3 is a curve of the width of expansion of the liquid spray in air and in vacuum as a function of the distance from the discharge opening of the nozzle.

FIG. 3 shows a curve depicting the spread of the liquid spray as a function of distance from the discharge opening of the nozzle in air and in vacuum. Compared to results known from the prior art, it can be seen that the collimation resulting in accordance with the invention is improved by about 30%.

The spread geometry of the generated cloud of droplet spray may be defined as $R=(0.32\pm0.02)\times h+r$, R being the radius of the spray/mist cloud, h being the distance from the supersonic nozzle and r being the radius of the discharge opening of the supersonic nozzle. A zero distance corresponds to the discharge opening of the supersonic nozzle.

Figure 4:
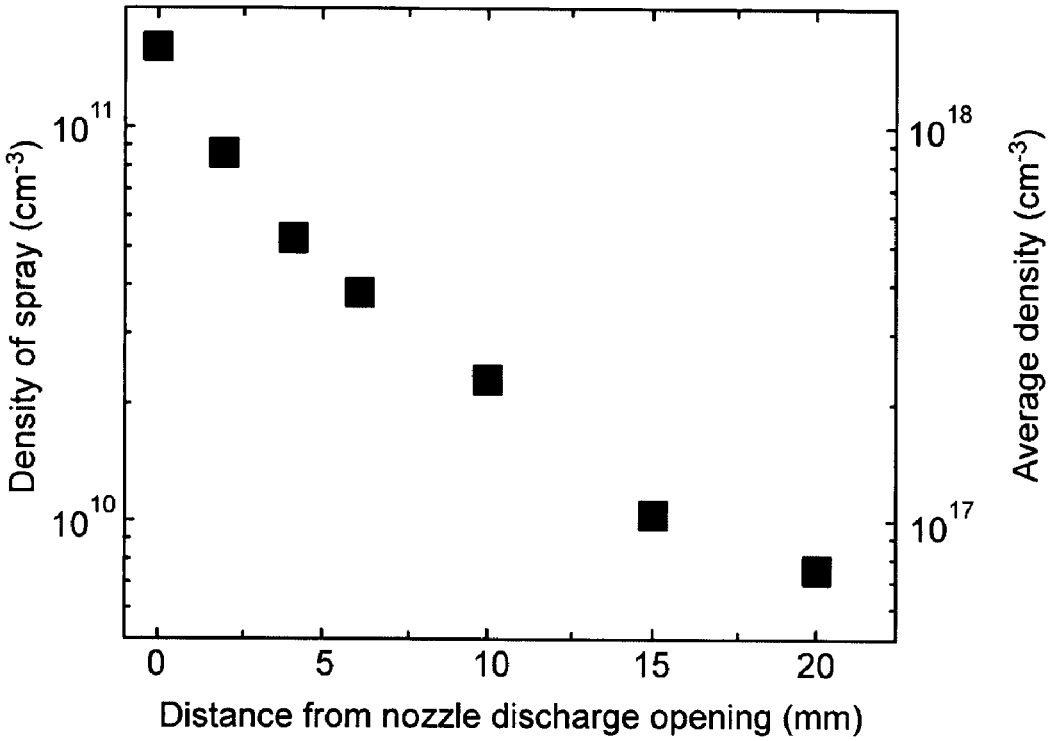
FIG. 4 is a curve of the density of the liquid spray as a function of the distance from the discharge opening of the nozzle.

FIG. 4 discloses a curve which depicts the dependency of the density of the droplets within the spray as well as the dependency of the mean atomic density in the spray upon the distance from the discharge opening of the nozzle. The measured droplet density varies as regards droplets of a 0.15 μm diameter from $(1.6\pm0.5)\cdot10^{11}$ droplets per cubic centimeter (or a mean molecular density of $1.5\cdot10^{18}$ $cm^{-3}$) directly at the discharge opening of the nozzle to $(7.5\pm0.7)\cdot10^{9}$ droplets/$cm^{-3}$ (or mean molecular density of $8\cdot10^{16}$ $cm^{-3}$) at a distance of 20 mm from the discharge opening. At this droplet size this constitutes a droplet density higher by up to three orders of magnitude than in currently described spray droplet sources. This is important for the conversion of irradiated laser energy.

Figure 5:
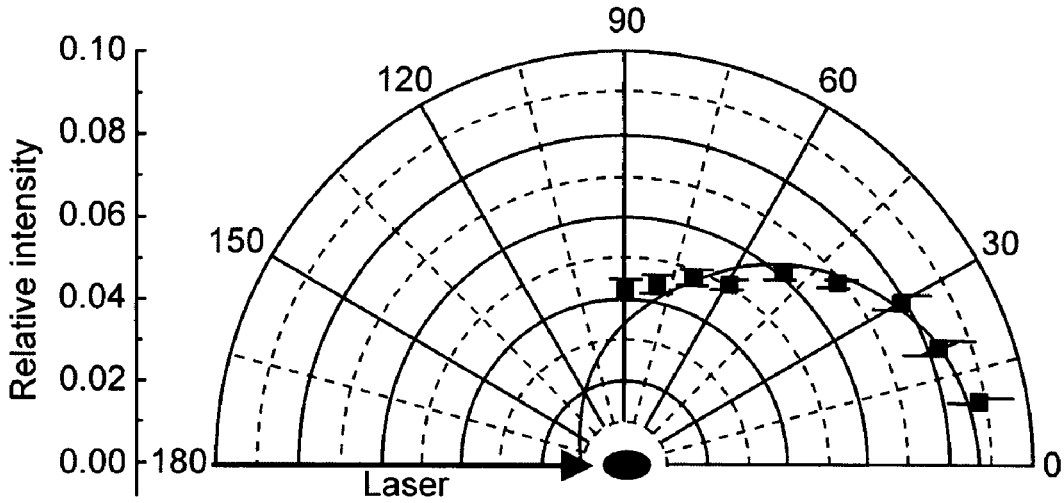
FIG. 5 is a curve of the relative intensity of scattered light measured by CCD.

FIG. 5 depicts the measurement data of the scattered light intensity as a function of the viewing angle. The solid line represents the theoretical distribution of the scattered light intensity of particles of a diameter of 0.15 μm. The correspondence with the measurement data indicates a closer distribution of the droplet sizes than in the prior art so that—unlike in the prior art—there is no need for a droplet size filter and that in this manner the effective droplet density is advantageously increased.

The invention claimed is:

1. An apparatus for generating a droplet target, comprising:

at least one receptacle for receiving a target liquid and adapted to have its interior maintained under high pressure;

an electromagnetic valve switching between open and closed states by pulses in the range of ms;

means for feeding target liquid to the valve from the receptacle;

a supersonic nozzle;

an expansion channel for feeding target liquid from the valve to the nozzle;

heating means associated with the expansion channel for converting target liquid therein to supersaturated vapor by a predetermined temperature; and insulating means between the electromagnetic valve and the heating means.

2. The apparatus of claim 1, wherein the pressure is maintained by a non-reactive gas.

3. The apparatus of claim 2, wherein the non-reactive gas is nitrogen.

4. The apparatus of claim 1, wherein the predetermined temperature is about 150° C.

5. The apparatus of claim 1, wherein the duration of the pulses is 2 ms.

6. The apparatus of claim 1, wherein the expansion channel is of a length from two mm to at least 20 mm and of a diameter of from at least 100 μm to at least one mm.

7. The apparatus of claim 6, wherein the length is 15 mm and the diameter is 1 mm.

8. The apparatus of claim 1, wherein the supersonic nozzle is provided with a conical opening angle 2θ of between 2° and 20°, an input opening larger than 100 μm in diameter and a conically shaped section of a length of between 2 and 10 mm.

9. The apparatus of claim 8, wherein the opening angle is 7°, the diameter is 500 μm and the length of the conically shaped section is 8 mm.

10. A method of making a droplet target, comprising the steps of:

filling a receptacle with a target liquid;

maintaining a predetermined pressure within the receptacle;

briefly opening the receptacle by means of a pulsed electromagnetic valve;

feeding the target liquid through the electromagnetic valve into an expansion channel;

heating the expansion channel to a temperature sufficient to convert the target liquid into a supersaturated vapor;

feeding the supersaturated vapor to a supersonic nozzle;

cooling the supersaturated vapor passing to the nozzle to condense to droplets; and discharging the droplets from the nozzle.

11. The method of claim 10 wherein the pressure is maintained by gaseous nitrogen at 35 bar and the valve is pulsed at 2 ms.

12. The method of claim 10, wherein the supersaturated vapor is fed to an expansion channel of a length of from two mm to at least 20 mm and a diameter of from at least 100 μm to at least one mm.

13. The method of claim 10, wherein the supersaturated vapor is fed into and is cooled in a supersonic nozzle having a conical opening angle 2θ between 2° and 20° and a conically shaped section of a length of 2 to 10 mm.

* * * * *